US009050708B2

(12) United States Patent
Schmitz

(10) Patent No.: US 9,050,708 B2
(45) Date of Patent: Jun. 9, 2015

(54) GRINDING DISK AND APPARATUS

(71) Applicant: Roland Schmitz, Vaihingen (DE)

(72) Inventor: Roland Schmitz, Vaihingen (DE)

(73) Assignee: EMAG HOLDING GMBH, Salach (DE)

( * ) Notice: Subject to any disclaimer, the term of this patent is extended or adjusted under 35 U.S.C. 154(b) by 72 days.

(21) Appl. No.: 13/953,318

(22) Filed: Jul. 29, 2013

(65) Prior Publication Data

US 2014/0030969 A1 Jan. 30, 2014

(51) Int. Cl.

| | |
|---|---|
| ***B24D 13/02*** | (2006.01) |
| ***B24B 49/08*** | (2006.01) |
| ***B24B 49/10*** | (2006.01) |
| ***B24B 5/42*** | (2006.01) |

(52) U.S. Cl.

CPC ..... *B24D 13/02* (2013.01); *B24B 49/08* (2013.01); *B24B 49/10* (2013.01); *B24B 5/42* (2013.01)

(58) Field of Classification Search

USPC ..... 451/495, 504, 53, 507, 548

See application file for complete search history.

(56) References Cited

U.S. PATENT DOCUMENTS

| | | | | |
|---|---|---|---|---|
| 1,461,514 | A * | 7/1923 | Burns | 451/548 |
| 3,145,511 | A * | 8/1964 | Bird et al. | 451/541 |
| 3,883,996 | A * | 5/1975 | Waller | 451/541 |
| 4,918,869 | A * | 4/1990 | Kitta | 451/288 |
| 5,351,447 | A * | 10/1994 | Grauert | 451/505 |
| 6,152,814 | A * | 11/2000 | Amarosa et al. | 451/526 |
| 6,908,267 | B1 * | 6/2005 | Tran et al. | 409/234 |
| 6,913,515 | B2 * | 7/2005 | Beaucage et al. | 451/7 |
| 8,002,612 | B2 * | 8/2011 | Fisher | 451/538 |
| 8,062,097 | B2 | 11/2011 | Clewes | |
| 2002/0086627 | A1 * | 7/2002 | Andrews et al. | 451/355 |
| 2010/0081365 | A1 * | 4/2010 | Clewes et al. | 451/51 |

* cited by examiner

*Primary Examiner* — Lee D Wilson
*Assistant Examiner* — Henry Hong
(74) *Attorney, Agent, or Firm* — Andrew Wilford

(57) ABSTRACT

A grinding wheel assembly has a support disk centered on an axis and having an outer edge and a pair of axially opposite faces. An annular abrasive ring is juxtaposed with the outer edge, and a flexible hinge formation joins the ring to the outer edge of the disk at one of the faces. An actuator body of controlledly radially variable dimension joins the ring to outer edge of the disk at the other of the faces for deforming the ring and flexing the hinge formation so as to vary a shape of an outer face of the ring radially of the axis. Thus with this system the exact shape of the outer face of the abrasive ring can be controlled remotely. The control can be very accurate, and can be monitored by sensors in a feedback system to ensure exact position of the outer ring surface.

9 Claims, 1 Drawing Sheet

GRINDING DISK AND APPARATUS

FIELD OF THE INVENTION

The present invention relates to grinding. More particularly this invention concerns a grinding apparatus.

BACKGROUND OF THE INVENTION

A typical grinding wheel is disk-shaped and is centered on an axis about which it is rotated when in use. The wheel has a generally cylindrical outer surface centered on the axis, and a pair of faces lying in respective planes perpendicular to the axis. At least a ring of material along its outer edge is made of an abrasive material.

U.S. Pat. No. 8,062,097 describes such a wheel adapted for abrasive rings that are rotation symmetrical but not cylindrical, for instance frustoconical. Such surfaces are seen on crowned main bearings and pins of crankshafts. To conform the outer surface, that is the radially outwardly directed outer periphery, of the grinding wheel, this patent proposes forming the ring of grinding material along the outer rim so that it is not symmetrical to a plane bisecting the disk and perpendicular to the disk axis. The disk is made somewhat flexible inward of this outer ring so, when the disk is rotated at high speed, the asymmetrical weight of the outer ring bends it to one side or the other and orients its outer surface such that the ring of abrasive can grind the noncylindrical camshaft surface. Different rotation speeds produce different deformations and different angles.

Grinding at different speeds necessarily excludes the possibility of dressing the grinding wheel at the nominal grinding speed. In addition, the method requires that the spindle speeds be matched to the specific deformation so that these speeds are no longer available as parameters for other modes of process optimization.

OBJECTS OF THE INVENTION

It is therefore an object of the present invention to provide an improved grinding disk and apparatus.

Another object is the provision of such an improved grinding disk and apparatus that overcomes the above-given disadvantages, in particular that has an outer grinding edge that can be deformed to produce the desired workpiece geometry while avoiding the known disadvantages of the prior art.

SUMMARY OF THE INVENTION

A grinding wheel assembly has according to the is invention a support disk centered on an axis and having an outer edge and a pair of axially opposite faces. An annular abrasive ring is juxtaposed with the outer edge, and a flexible hinge formation joins the ring to the outer edge of the disk at one of the faces. An actuator body of controlledly radially variable dimension joins the ring to outer edge of the disk at the other of the faces for deforming the ring and flexing the hinge formation so as to vary a shape of an outer face of the ring radially of the axis.

Thus with this system the exact shape of the outer face of the abrasive ring can be controlled remotely. The control can be very accurate, and can be monitored by sensors in a feedback system to ensure exact position of the outer ring surface.

According to the invention the disk is formed with an annular and axially open groove radially inward of the abrasive ring and defining an outer annular strip to which the ring is attached. The hinge formation is unitarily formed with the strip and with the disk. The actuator is annular and is braced radially between the strip and the support disk.

In one embodiment of the invention, the actuator is an annular body of material that can be thermally expanded or contracted. It can be associated with means for cooling, e.g. a nozzle emitting a cold fluid and thereby radially shrinking the annular body. Alternately it is provided with means for heating the body. In this latter case the annular body can be of a material in which eddy currents can be generated by a magnetic field. Means such as an electric coil is juxtaposed with the is body for generating a magnetic field that generates eddy currents in and heats the body, thereby swelling it. In yet another embodiment the actuator is hollow annular body. Means such as a supply of gas under subatmospheric or superatmospheric pressure and a conduit are connected to the cavity or interior of the body to radially swell or shrink it.

BRIEF DESCRIPTION OF THE DRAWING

The above and other objects, features, and advantages will become more readily apparent from the following description, reference being made to the accompanying drawing in which.

DETAILED DESCRIPTION OF THE INVENTION

Figure 1:
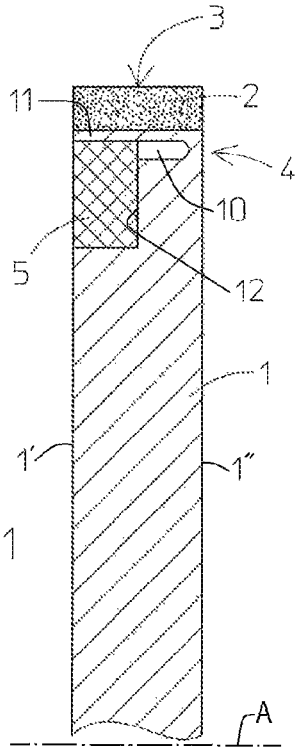
FIG. 1 is a section taken along a radial plane a grinding wheel according to the invention with an expansion element.

As seen in FIG. 1 a support disk 1 is a disk of substantially cylindrical shape and centered an axis A. It is fairly rigid and has a pair of axially opposite planar faces 1' and 1" perpendicular to and spaced along the axis A and is surrounded by a ring 2 of grinding material with a rectangular cross-sectional shape. This ring 2 normally has a cylindrical outer surface and is fixed to the disk 1 so that the ring 2 is also centered on the axis A and lies between the plane of the faces 1' and 1" of the disk 1.

The disk 1 is formed near its outer edge with an axially open annular groove 10 extending almost the full thickness of the disk 1 between its faces 1' and 1" and close to the outer periphery of the disk 1 so as to define a narrow hinge region 4 that connects the body of the disk 1 to a thin outer strip 11 of annular shape. The ring 2 is fixed to the cylindrical outer face of this strip 2.

According to the invention the disk 1 is formed radially inward of the annular strip 11 and opening into the groove 10 with an axially open square-section groove 12 in which is provided actuating means in the form of an actuator 5 of controlledly variable radial dimension. This actuator 5 is here an annular body with an inner periphery bearing directly on an inner flank of the groove 12 and an outer periphery bearing directly on a radial inner face of the annular strip 11.

The disk 1 is made of a limitedly elastically deformable material so that the hinge 4 can flex and allow the outer surface 3 of the abrasive ring 2 to assume a shape other than cylindrical, typically frustoconical. Whether the actuator 5 is controlled to reduce or increase its radial dimension determines the angular position of this surface 3.

Figure 2:
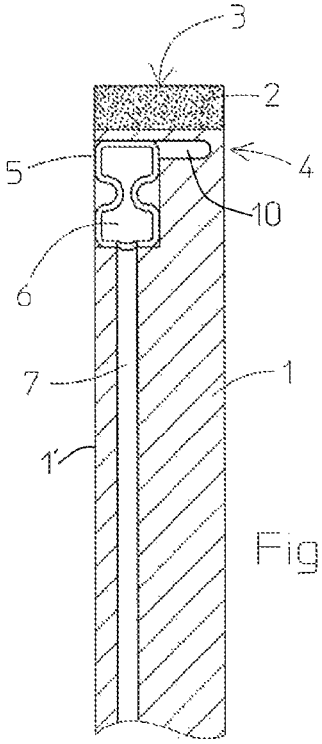
FIG. 2 is a view like FIG. 1 showing a grinding wheel that can be fluidically actuated.

In FIG. 2 the actuator 5 is a hollow and elastically flexible expansion element 5 that is formed with a cavity 6 that is connected through a pressure line 7 to an unillustrated pump or source of fluid under super or subatmospheric pressure. Varying the pressure raises or lowers the edge of the ring 2 at the face 1' by a few millimeters, although FIGS. 3 and 4 show a much more exaggerated deflection.

Figure 3:
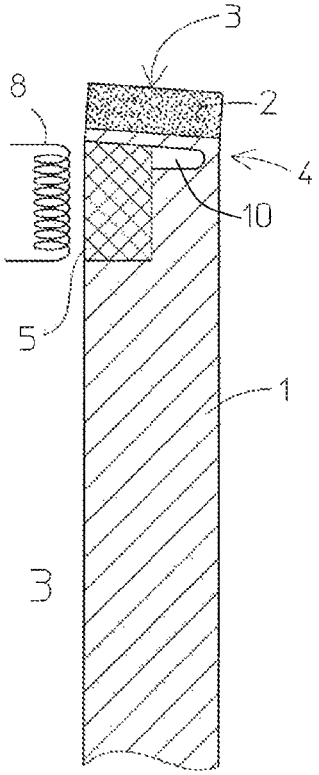
FIG. 3 is a view like FIG. 1 showing a grinding wheel with an inductively heated expansion element.

FIG. 3 shows that the actuating or heating means is an induction coil 8 closely axially spaced from an electrically conductive expansion element forming the actuator 5. Passing an alternating current through the coil 8 causes it to generate an electromagnet field in the expansion element 5. The resultant eddy currents due to the ohmic resistance of expansion element 5 result in the generation of heat. The electricity fed to the coil 8 can be pulsed synchronously with rotation of the wheel so that heat is generated only at those sites where the expansion element 5 is penetrated by the electromagnetic field. As a result, the entire grinding wheel does not have to be brought up to a higher temperature level. The very short response time enables an extremely precise increase in temperature to be achieved. FIG. 3 shows the expansion element 5 when hot. The support disk 1 and the abrasive ring 2 thereon are elastically deformed by the expansion. This deformation causes the abrasive ring 3 to expand on one side, and to be frustoconical rather than cylindrical in shape.

Figure 4:
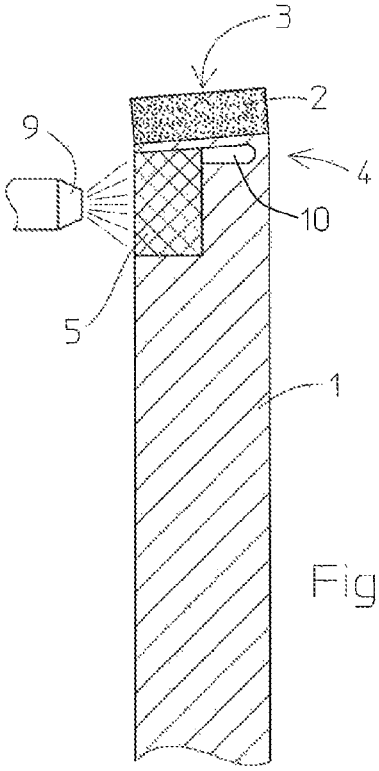
FIG. 4 is a view like FIG. 1 of a grinding wheel with a cooled expansion element.

Instead of the induction coil, the actuating or heating/cooling means can be a coolant nozzle 9 associated with the expansion element forming the actuator 5 in FIG. 4. The coolant causes the temperature to be reduced and thus expansion element 5 to shrink radially, with the result that the grinding ring 3 assumes a mirror-inversed frustoconical shape instead of an expanded state. Instead of a coolant, a hot liquid can be sprayed to axially swell the element 5. In especially advantageous fashion, crowned workpiece surfaces can be generated by means of abrasive ring 3 that has thereby been deformed into this mirror-inversed shape. In similarly advantageous fashion, the abrasive ring 3 can be given a frustoconical shape right at the start of the machining, then changed to the desired shape toward the end of the machining process solely by cooling or heating it.

I claim:

1. A grinding wheel assembly comprising:

a support disk centered on an axis, having an outer edge and a pair of axially opposite faces and formed radially inward of the outer edge with an annular and axially open groove defining an outer annular strip itself forming the outer edge;

an annular abrasive ring attached to the outer edge formed by the strip;

a flexible hinge formation joining the strip to the disk at one of the faces; and actuating means of controlledly radially variable dimension engaging the strip at the other of the faces for deforming the ring and flexing the hinge formation so as to vary a shape of the outer face of the ring radially of the axis.

2. The grinding wheel assembly defined in claim 1, wherein the hinge formation is unitarily formed with the strip and with the disk.

3. The grinding wheel assembly defined in claim 1, wherein the actuating means is annular and is braced radially between the strip and the support disk.

4. The grinding wheel assembly defined in claim 3, wherein the actuating means is an annular body of material that can be thermally expanded or contracted.

5. The grinding wheel assembly defined in claim 4, further comprising:

means for cooling and thereby radially shrinking the annular body.

6. The grinding wheel assembly defined in claim 4, further comprising means for heating and thereby radially swelling the annular body.

7. The grinding wheel assembly defined in claim 3, wherein the actuating means is a hollow annular body.

8. The grinding wheel assembly defined in claim 7, further comprising means for supplying super or subatmospheric pressure to an interior of and thereby radially swelling or shrinking the annular body.

9. The grinding wheel assembly defined in claim 6, wherein the annular body is of a material in which eddy currents can be generated by a magnetic field, the assembly further comprising:

means juxtaposed with the body for generating a magnetic field that generates eddy currents in and heats the body.

* * * * *